US006812892B2

(12) United States Patent
Tai et al.

(10) Patent No.: US 6,812,892 B2
(45) Date of Patent: Nov. 2, 2004

(54) DUAL BAND ANTENNA

(75) Inventors: Lung-Sheng Tai, Tu-chen (TW); Hsien-Chu Lin, Tu-Chen (TW); Chia-Ming Kuo, Tu-chen (TW); Zhen-Da Hung, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,959

(22) Filed: Dec. 26, 2002

(65) Prior Publication Data

US 2004/0104849 A1 Jun. 3, 2004

(30) Foreign Application Priority Data

Nov. 29, 2002 (TW) ..... 91219299

(51) Int. Cl.[7] ..... H01Q 1/38
(52) U.S. Cl. ..... 343/700 MS; 343/702
(58) Field of Search ..... 343/700 MS, 702, 343/829, 846, 830, 848

(56) References Cited

U.S. PATENT DOCUMENTS 5,926,139 A 7/1999 Korisch
6,166,694 A 12/2000 Ying

*Primary Examiner*—Tho Phan
(74) *Attorney, Agent, or Firm*—Wei Te Chung

(57) ABSTRACT

A dual band antenna (1) includes a planar conductive element and a feeder cable (6) electrically connecting to the conductive element. The conductive element includes a first radiating strip (2), a second radiating strip (3), a ground portion (5), and a connection strip (4) interconnecting the first and the second radiating strips with the ground portion. The first radiating strip and the connection strip are configured to function as a first planar inverted-F antenna (PIFA) operating in a higher frequency band. The second radiating strip and the connection strip are configured to function as a second PIFA operating in a lower frequency band. The first and the second radiating strip, the ground portion and the connection strip are all disposed in the same plane.

15 Claims, 9 Drawing Sheets

Scale: 5dBi/div
Operating Frequency: 2.45 GHz
Horizontally polarized

Scale: 5dBi/div
Operating Frequency: 2.45 GHz
Vertically polarized

Scale: 5dBi/div
Operating Frequency: 5.35 GHz
Horizontally polarized

Scale: 5dBi/div
Operating Frequency: 5.35 GHz
Vertically polarized

Scale: 5dBi/div
Operating Frequency: 5.725 GHz
Horizontally polarized

Scale: 5dBi/div
Operating Frequency: 5.725 GHz
Vertically polarized

DUAL BAND ANTENNA

CROSS-REFERENCE TO RELATED APPLICATION

This application is a U.S. patent application entitled "DUAL BAND ANTENNA", invented by Tai Lung-Sheng, Lin Hsien-Chu and Kuo Chia-Ming, contemporaneously filed and assigned to the same assignee of the present invention.

BACKGROUND OF THE INVENTION

1. Field of the Invention

The present invention relates to an antenna, and in particular to an antenna which is capable of operating in two distinct frequency bands.

2. Description of the Prior Art

In recent years, planar inverted-F antennas (PIFA) have become increasingly popular. U.S. Pat. No. 5,926,139 issued to Korich on Jul. 20, 1999 discloses a conventional antenna. The conventional antenna comprises a planar dielectric substrate having opposite upper and lower major surfaces. A ground plane and a radiating element are respectively disposed on opposite major surfaces of the substrate. The radiating element comprises a first radiating portion and a second radiating portion. The first radiating portion is sized to function as a first PIFA operating in a first frequency band. The second radiating portion is sized to function as a second PIFA operating in a second frequency band. Therefore, the conventional antenna is capable of operating in two frequency bands. However, because the radiating element and the ground plane are respectively disposed on the opposite major surfaces of the substrate, the antenna has to form a grounding pin extending through the dielectric substrate to interconnect the ground plane and the radiating element, and a feed pin extending through the ground plane and the substrate to couple the radiating element to a transceiver circuitry. The conventional antenna has, therefore, a complex structure. Furthermore, the conventional antenna has a narrow bandwidth.

Hence, an improved antenna is desired to overcome the above-mentioned shortcomings of existing antennas.

BRIEF SUMMARY OF THE INVENTION

A main object of the present invention is to provide a dual band antenna having a simple structure and having a wide bandwidth.

A dual band antenna in accordance with the present invention is mounted in an electronic device for transmitting or receiving signals. The dual band antenna comprises a planar conductive element and a feeder cable electrically connecting to the conductive element. The conductive element includes a first radiating strip, a second radiating strip, a ground portion, and a connection strip. The connection strip interconnects the first and the second radiating strips with the ground portion. The first radiating strip and the connection strip are configured and sized to function as a first planar inverted-F antenna (PIFA) operating in a higher frequency band. The second radiating strip and the connection strip are configured and sized to function as a second PIFA operating in a lower frequency band. Because the first and the second radiating strips, the ground portion and the connection strip are all disposed in the same plane, the dual band antenna has a simple structure and has a wide bandwidth in the higher frequency band.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
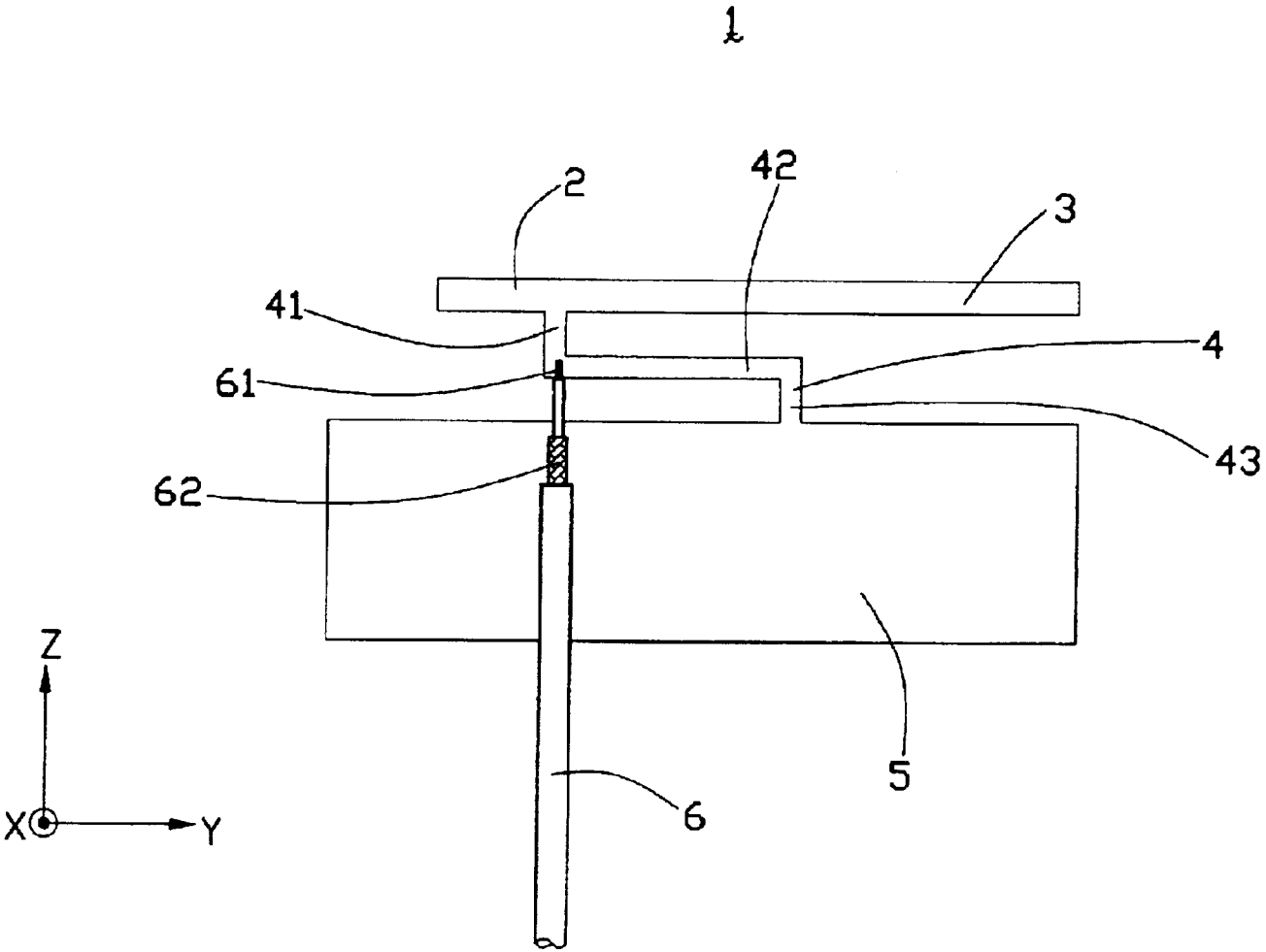
FIG. 1 is a top view of a dual band antenna in accordance with the present invention.

Referring to FIG. 1, a dual band antenna 1 in accordance with a preferred embodiment of the present invention is mounted in an electrical device (not shown), such as laptop computer, desktop computer or mobile phone, for transmitting or receiving signals. The dual band antenna 1 comprises a planar conductive element (not labeled) and a coaxial feeder cable 6.

The planar conductive element of the dual band antenna 1 can be formed of a planar metal sheet or can be formed on a same major surface of a planar insulative substrate (such as a printed circuit board, not shown). The conductive element comprises a horizontal first radiating strip 2, a horizontal second radiating strip 3 extending from the first radiating strip 2, a ground portion 5, and a connection strip 4. The connection strip 4 interconnects the first and the second radiating strips 2, 3 with the ground portion 5. The connection strip 4 comprises an upright first segment 41, a middle second segment 42 and an upright third segment 43. The first segment 41 extends downwardly from a joint of the first and the second radiating strips 2, 3. The second segment 42 horizontally extends from a lower end of the first segment 41. The third segment 43 extends downwardly from the second segment 42. The ground portion 5 is rectangular and connects with a lower end of the third segment 43.

The coaxial feeder cable 6 has an inner core conductor 61 and an outer shield conductor 62 surrounding the inner core conductor 61. The inner core conductor 61 is soldered to the lower end of the first segment 41 of the connection strip 4 for transmitting signals between the dual band antenna 1 and a signal unit of an electrical device (not shown). The outer shield conductor 62 is soldered on the ground portion 5 for grounding the dual band antenna 1. The distance between the solder point of the outer shield conductor 62 on the ground portion 5 and the third segment 43 is predetermined to achieve a desired matching impedance for two distinct frequency bands.

Figure 2:
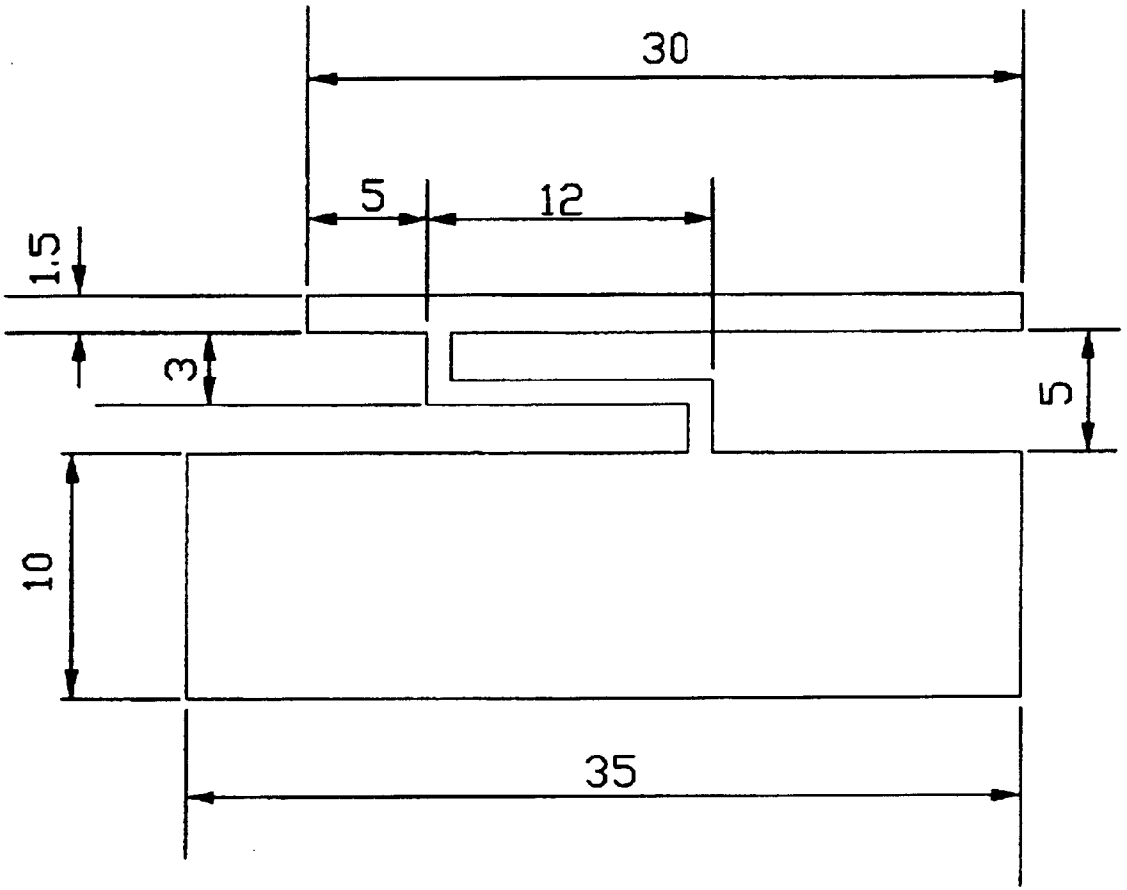
FIG. 2 is a top view of the dual band antenna of FIG. 1 with a feeder cable thereof removed for clarity, showing detailed dimensions thereof.
Figure 3:
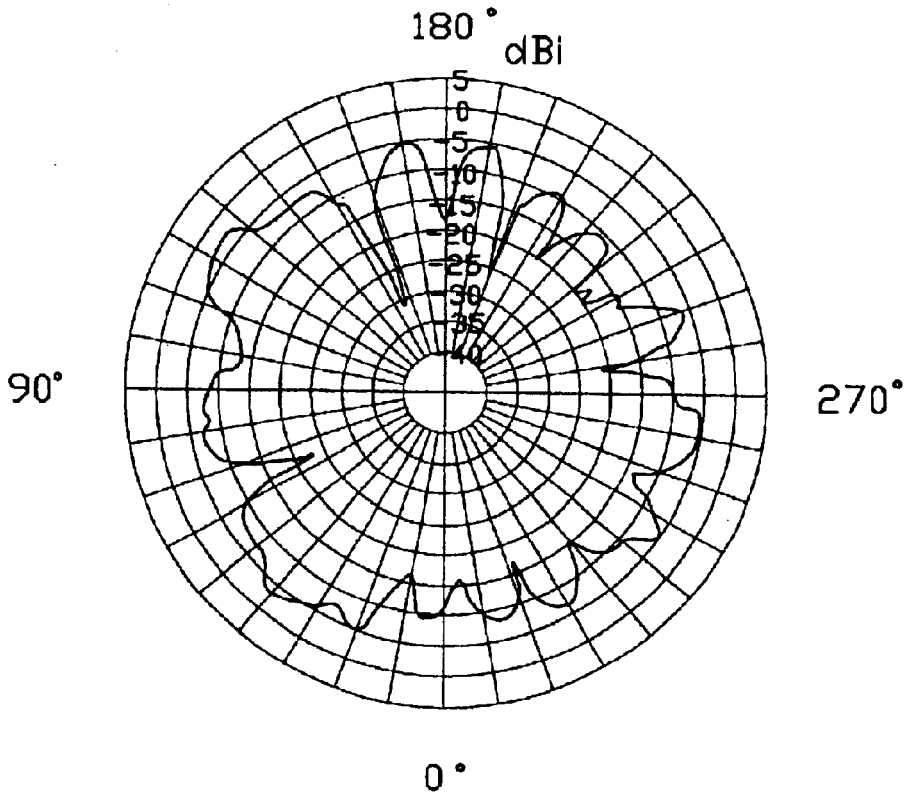
FIG. 3 is a horizontally polarized principle plane radiation pattern (where the principle plane is an X-Y plane) of the dual band antenna of FIG. 1 operating at a frequency of 2.45 GHz.
Figure 4:
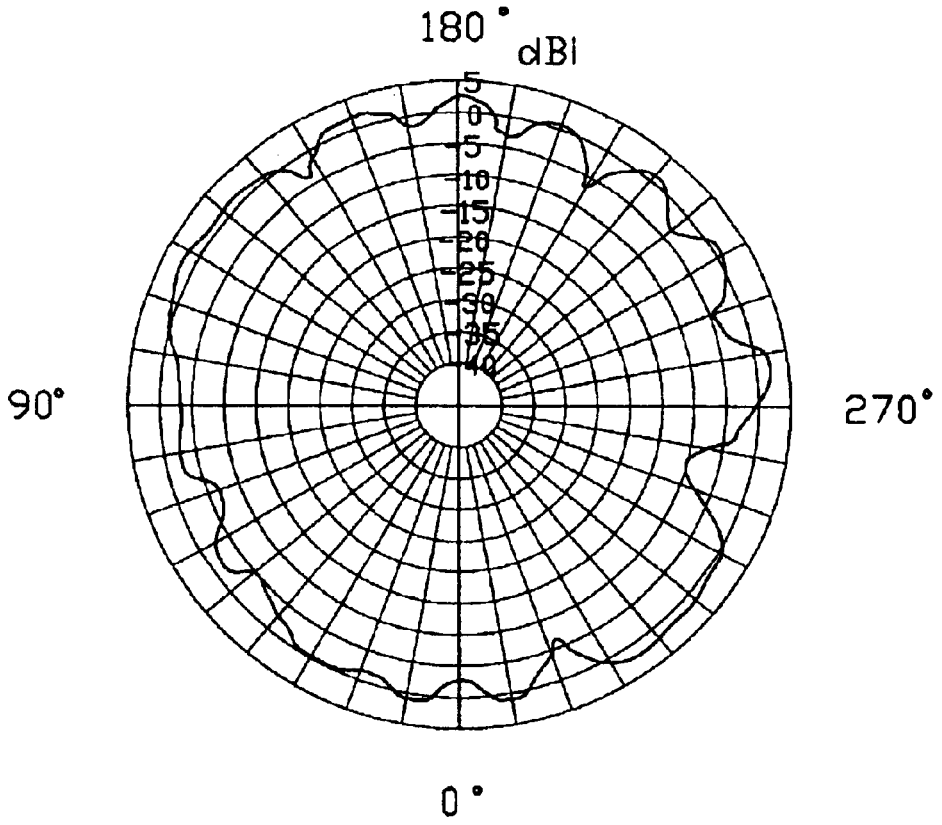
FIG. 4 is a vertically polarized principle plane radiation pattern (where the principle plane is an X-Y plane) of the dual band antenna of FIG. 1 operating at a frequency of 2.45 GHz.
Figure 5:
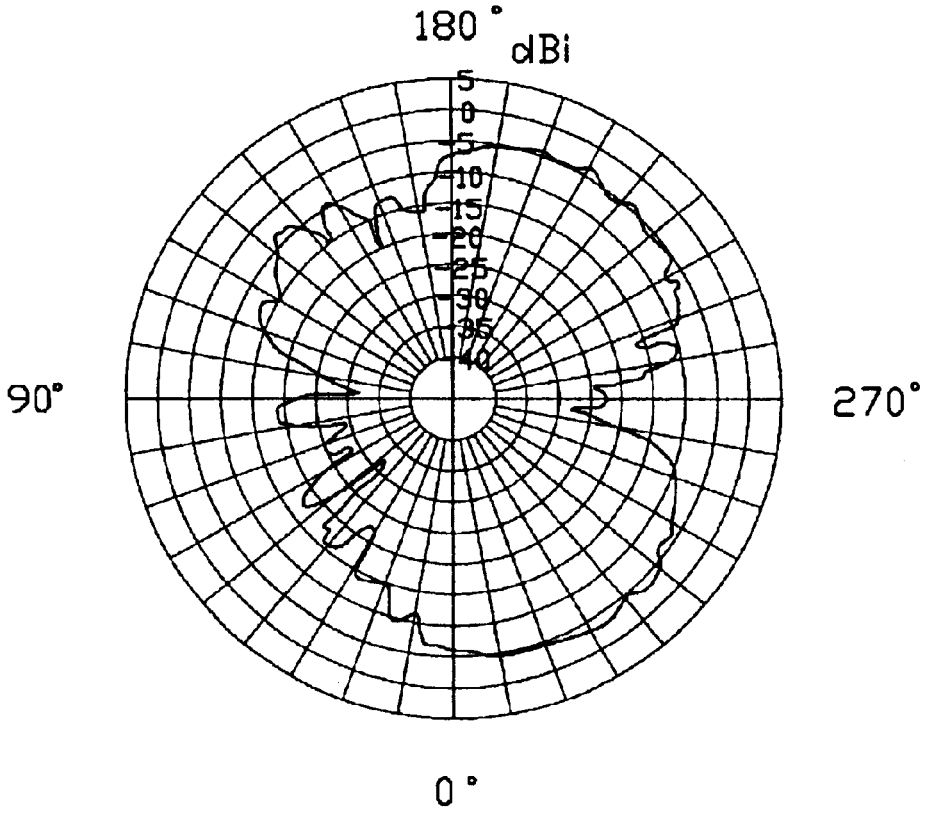
FIG. 5 is a horizontally polarized principle plane radiation pattern (where the principle plane is an X-Y plane) of the dual band antenna of FIG. 1 operating at a frequency of 5.35 GHz.
Figure 6:
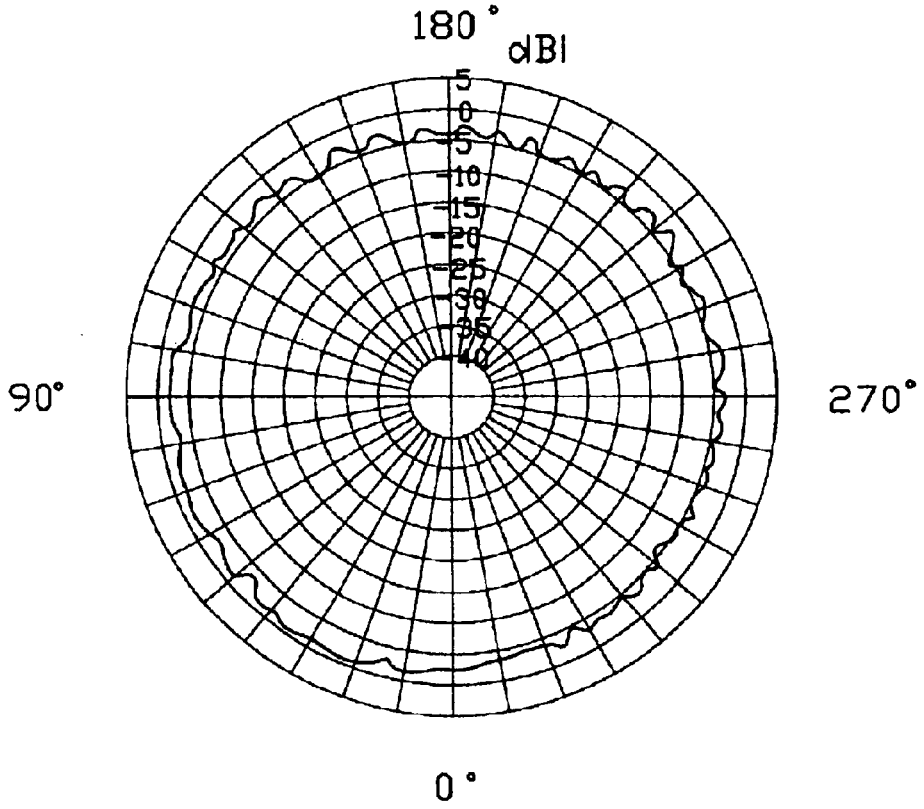
FIG. 6 is a vertically polarized principle plane radiation pattern (where the principle plane is an X-Y plane) of the dual band antenna of FIG. 1 operating at a frequency of 5.35 GHz.
Figure 7:
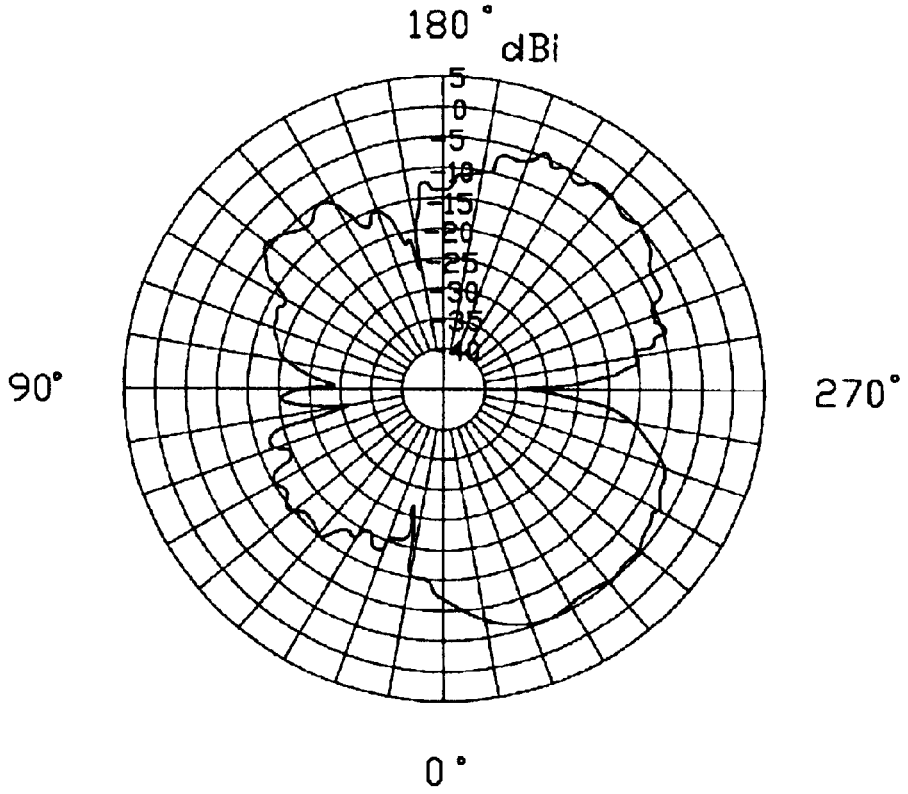
FIG. 7 is a horizontally polarized principle plane radiation pattern (where the principle plane is an X-Y plane) of the dual band antenna of FIG. 1 operating at a frequency of 5.725 GHz.
Figure 8:
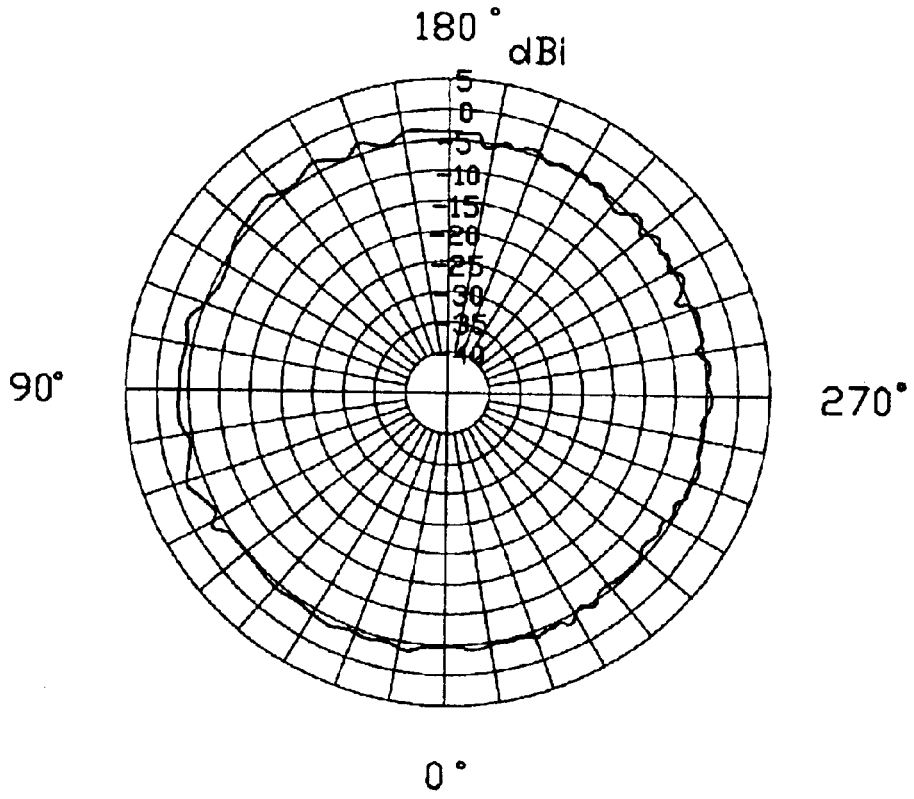
FIG. 8 is a vertically polarized principle plane radiation pattern (where the principle plane is an X-Y plane) of the dual band antenna of FIG. 1 operating at a frequency of 5.725 GHz.

Detailed dimensions of the dual band antenna 1 are shown in FIG. 2. The dimensions are in millimeters and are such that the dual band antenna 1 is configured to resonate within the two frequency bands. The first radiating strip 2 and the connection strip 4 are configured and sized to function as a first planar inverted-F antenna (PIFA), resonating in a higher frequency band between 4.84 GHz and 5.80 GHz (i.e., the 5 GHz frequency band). The second radiating strip 3 and the connection strip 4 are configured and sized to function as a second PIFA, resonating in a lower frequency band between 2.39 GHz and 2.53 GHz (i.e., the 2.45 GHz frequency band). The first and the second PIFAs constitute nearly independent regions having different resonant frequencies.

FIGS. 3–8 respectively show horizontally and vertically polarized principle plane radiation patterns of the dual band antenna 1 operating at frequencies of 2.45 GHz, 5.35 GHz and 5.725 GHz (the principle plane is the X-Y plane shown in FIG. 1). Note that each radiation pattern is close to a corresponding optimal radiation pattern.

Figure 9:
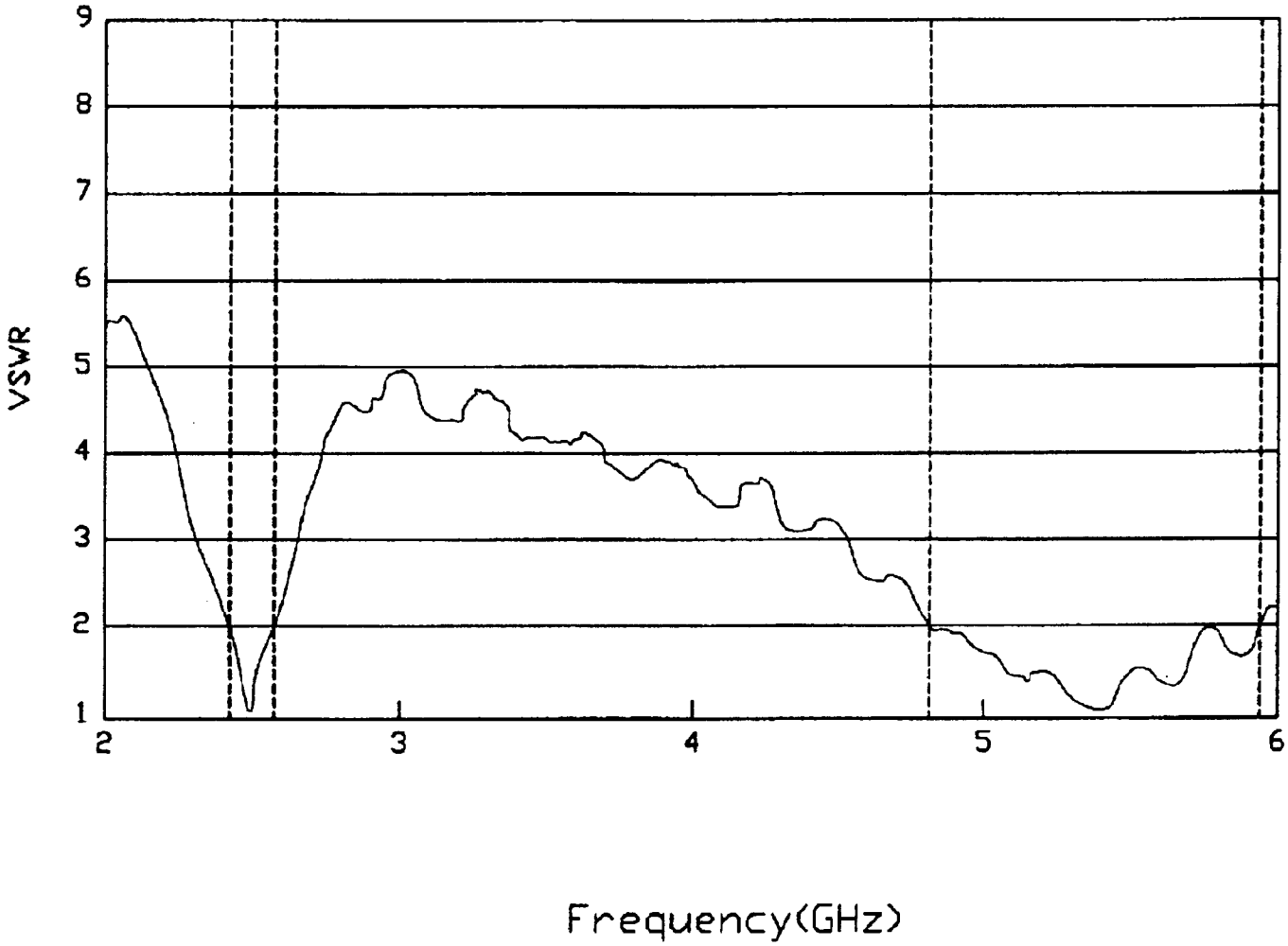
FIG. 9 is a test chart recording for the dual band antenna of FIG. 1, showing Voltage Standing Wave Ratio (VSWR) as a function of frequency.

FIG. 9 shows a test chart recording of Voltage Standing Wave Ratio (VSWR) of the dual band antenna 1 as a function of frequency. Note that VSWR drops below the desirable maximum value "2" in the 2.45 GHz frequency band and in the 5 GHz frequency band, indicating acceptably efficient operation in these two frequency bands and a wide bandwidth in the 5 GHz frequency band.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dual band antenna comprising:

a conductive element comprising a first radiating portion, a second radiating portion, a ground portion, and a connection portion interconnecting the first and the second radiating portions with the ground portion, the connection portion comprising a first segment, a third segment, and a second segment interconnecting the first and the third segments, the first segment extending from a joint of the first and the second radiating portions, and the third segment connecting with the ground portion; and a feeder cable electrically connecting to the conductive element.

2. The dual band antenna as claimed in claim 1, wherein the first radiating portion and the connection portion are configured and sized to function as a first planar inverted-F antenna (PIFA) operating at a higher frequency band.

3. The dual band antenna as claimed in claim 1, wherein the second radiating portion and the connection portion are configured and sized to function as a second planar inverted-F antenna (PIFA) operating at a lower frequency band.

4. The dual band antenna as claimed in claim 1, wherein the feeder cable is a coaxial cable and comprises an inner core conductor and an outer shield conductor.

5. The dual band antenna as claimed in claim 4, wherein the inner core conductor is electrically connected to the first segment of the connection portion and the outer shield conductor is electrically connected to the ground portion.

6. The dual band antenna as claimed in claim 1, wherein the dual band antenna further comprises a planar insulative substrate, wherein the ground portion, the fist and the second radiating portion and the connection portion are all disposed on a major surface of the substrate.

7. The dual band antenna as claimed in claim 1, wherein the second radiating portion extends from the first radiating portion and aligns with the first radiating portion.

8. The dual band antenna as claimed in claim 1, wherein the first and the second radiating portions, the ground portion and the connection portion being all arranged in a same plane.

9. A dual band antenna comprising:

a planar conductive element including:

a large grounding portion;

a strip-like radiation portion extending in a first direction and parallel to said grounding portion; and a lying Z-like connection portion with two opposite ends connected to said radiation portion and said grounding portion, respectively, said Z-like connection portion including a first segment and a second segment both extending in a second direction perpendicular to said first direction and connected with each other via a third segment; and a feeder cable including an outer braiding connected to said grounding portion and an inner conductor connected to a position of said third segment along said first direction.

10. The antenna as claimed in claim 9, wherein said third segment extends in said first direction.

11. The antenna as claimed in claim 9, wherein said feed cable extends in said second direction.

12. A dual band antenna comprising:

a planar conductive element including:

a large grounding portion;

a strip-like radiation portion extending in a first direction and parallel to said grounding portion; and a lying Z-like connection portion with opposite first and second ends connected to said radiation portion and said grounding portion, respectively, said Z-like connection portion including a first segment and a second segment connected with each other via a third segment; and a feeder cable including an outer braiding connected to said grounding portion and an inner conductor connected to a position of said third segment; wherein said first end divides said radiation portion into two unequal sections so as to form two PIFAS back to back arranged with each other.

13. The dual band antenna as claimed in claim 12, wherein the feeder cable is a coaxial cable and comprises an inner core conductor and an outer shield conductor.

14. The dual band antenna as claimed in claim 13, wherein the inner core conductor is electrically connected to the first segment of the connection portion and the outer shield conductor is electrically connected to the ground portion.

15. The dual band antenna as claimed in claim 12, wherein the dual band antenna further comprises a planar insulative substrate, wherein the ground portion, the first and the second radiating portion and the connection portion are all disposed on a major surface of the substrate.

* * * * *